United States Patent [19]

Bersani

[11] Patent Number: 4,653,659

[45] Date of Patent: Mar. 31, 1987

[54] CONVEYABLE CONTAINER-SHAPED STRUCTURAL ELEMENTS, AND STRUCTURES OBTAINED FROM SUCH STRUCTURAL ELEMENTS

[75] Inventor: Pierre Bersani, Bursinel, Switzerland

[73] Assignee: Parteurosa, Societe Anonyme, Luxemburg, Luxembourg

[21] Appl. No.: 784,238

[22] Filed: Oct. 4, 1985

[30] Foreign Application Priority Data

Oct. 15, 1984 [LU] Luxembourg ..... 85595

[51] Int. Cl.[4] ..... B65D 21/00

[52] U.S. Cl. ..... 220/1.5; 220/6; 220/7

[58] Field of Search ..... 220/1.5, 6, 7, 4 F, 220/23.4

[56] References Cited

U.S. PATENT DOCUMENTS

| | | | |
|---|---|---|---|
| 2,963,310 | 12/1960 | Abolins . | |
| 3,529,741 | 9/1970 | Walker et al. | 220/7 |
| 3,691,595 | 9/1972 | Backtemann et al. . | |
| 4,049,149 | 9/1977 | Durenec . | |
| 4,162,737 | 7/1979 | Clive-Smith | 220/1.5 |
| 4,177,907 | 12/1979 | Funaioli et al. | 220/1.5 |
| 4,212,251 | 7/1980 | DiMartino . | |
| 4,240,359 | 12/1980 | Howe | 220/7 X |
| 4,319,732 | 3/1982 | Godfrey | 220/6 X |
| 4,341,495 | 7/1982 | Del'Acqua | 220/1.5 X |
| 4,355,732 | 10/1982 | Nessfield | 220/1.5 |

FOREIGN PATENT DOCUMENTS

| | | |
|---|---|---|
| 838053 | 5/1976 | Belgium . |
| 0077103 | 4/1983 | European Pat. Off. . |
| 1580273 | 9/1969 | France . |
| 2476716 | 8/1981 | France . |
| 84/00573 | 2/1984 | PCT Int'l Appl. . |
| 1217334 | 12/1970 | United Kingdom . |
| 1347177 | 2/1974 | United Kingdom . |
| 1545902 | 5/1979 | United Kingdom . |
| 2051172 | 1/1981 | United Kingdom . |
| 1603613 | 11/1981 | United Kingdom . |

OTHER PUBLICATIONS

*Marine Technology*, "Container System Design Developments Over Two Decades", L. A. Harlander, vol. 19, No. 4, Oct. 1982, pp. 364–376.

*Primary Examiner*—Steven M. Pollard
*Attorney, Agent, or Firm*—Spencer & Frank

[57] ABSTRACT

Conveyable container-shaped structural elements, and structures obtained from such structural elements. The container-shaped structural element comprises at least one hinged panel fixedly connected to two adjacent standard corner fittings lying along that panel edge opposite the edge close to the hinging axis, both of the corner fittings lying in the closed position of the hinged panel, in the standard position thereof for handling the container, and forming with the frame remaining portion, a container meeting the standard sizes for conveyable containers. The structures according to the invention comprise at least one such container with the hinged panel thereof in opened position, and means for connecting same to another container or the support thereof.

13 Claims, 9 Drawing Figures

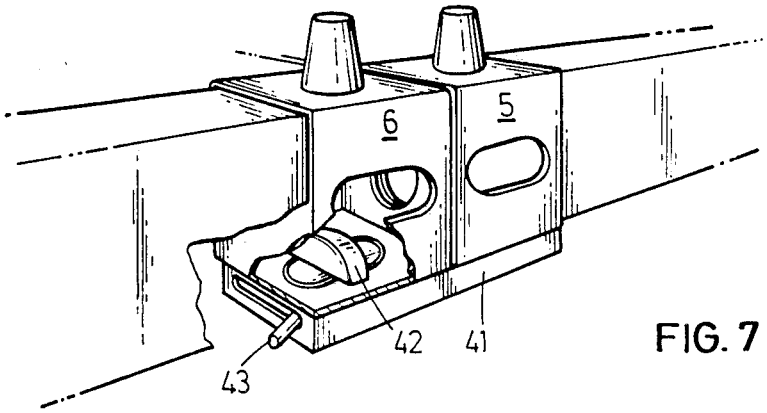
FIG. 7
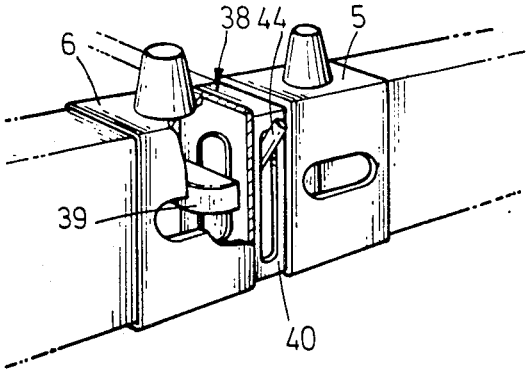
FIG. 8
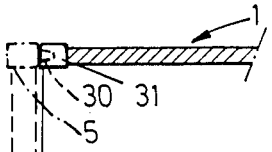
FIG. 6
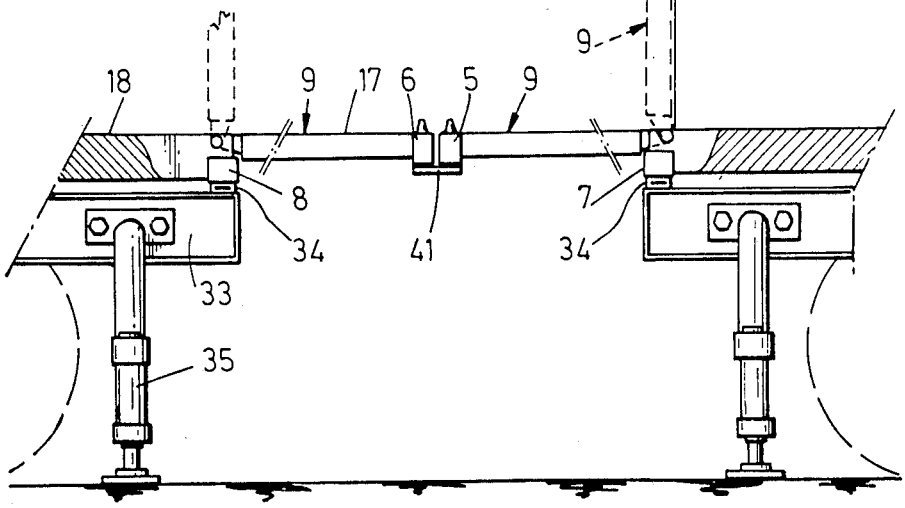

CONVEYABLE CONTAINER-SHAPED STRUCTURAL ELEMENTS, AND STRUCTURES OBTAINED FROM SUCH STRUCTURAL ELEMENTS

BACKGROUND OF THE INVENTION

This invention relates to a container shaped conveyable structural element of standard size, comprising corner fittings of standard size for handling the container, a frame bearing said corner fittings in the mutual standard positions thereof, at least one hinged panel supported by the frame and able to swing outwards about an axis lying approximately along the one edge thereof, between an opened position and a closed position, the frame and hinged panel having removable mutual fastening means, as well as at least one stop means for the hinged panel in the opened position thereof.

It should be understood that the term "standard size" in the present specification means "a size fulfilling the international standards ISO for conveying and handling containers".

There are already known conveyable containers of this type which are disclosed, for example in French Patent Application FR-2476716 and Great-Britain Pat. Nos. GB-1,603,613 and GB-1,347,177. In these Patents, a complete or part side wall from a conveyable container, for example a truck-conveyable container, having standard corner fittings for the handling thereof, is supported by the container frame in such a way as to be swingable outwards about an axis lying along the one edge thereof, down to an opened position in which stop fittings lock and support the side wall. In the above publications, the container frame and corner fittings remain completely integral with one another, and in the unfolded position of the movable panel, the plane of the inner side of said panel is staggered relative to the plane of the inner sides of the other container panels.

There are also known containers, possibly conveyable containers, some walls of which are hinged and are unfoldable outwards of the container. There may for example be mentioned those container embodiments described in Belgian Pat. No. BE-838053 in FIGS. 1 to 3, in Belgian Pat. No. BE-883303, in European Patent Application EP 77103, and an International Patent Application WO-84/00573. None of these embodiments, which are all comprised of parallelepiped-shaped containers, fulfill the standard handling standards, as none bear standard corner fittings. In Patent Applications EP-77103 and WO-84/00573, it is rather a matter of walls folded-back on one another, which are unfolded to obtain a structure the volume of which is much larger than the container during conveying thereof. The embodiment described in FIGS. 4 and 5 of Pat. No. BE-838053 pertains to a container bearing standard corner fittings, but in such a case the removable panels are not hinged and swingable, they are only connected to the frame through locking or snapping means.

There are also known standard stackable pallets, which are consequently provided on the end of the four vertical uprights thereof, with standard end fittings which are identical with the container standard corner fittings, said uprights being foldable inwards on the pallet platform to enable stacking such pallets when they are empty. There may notably be mentioned by way of example, Great-Britain Pat. No. GB-1217334 and French Pat. No. FR-1,580,273. In French Pat. No. FR-1,580,273, the lower end fittings from the vertical uprights swing together with the uprights during folding-back, and it is required to provide for an arrangement with twin lower standard corner fittings, to allow handling the pallets in their folded condition. In Pat. No. GB-1217334, the vertical uprights swing without the lower corner fittings as they are folded-back. Such pallets are not however containers and their designers did not have to face the problems of a wall swinging relative to a fixed frame which is also present in the top part of the containers, nor the alignment problems of the hinged wall planes in opened position with the fixed container walls, and the problems for stopping said hinged walls in an opened position.

This invention has for an object the design of conveyable standard-type container-shaped structural elements, which allow swinging at least one hinged panel about an axis lying along the one lengthwise edge thereof together with those corner fittings lying along the opposite edge thereof, while additionally providing a solution to said problems.

SUMMARY OF THE INVENTION

This problem is solved according to the invention with a conveyable container-shaped structural element as described at the start, and characterized in that each hinged panel is fixedly connected to two adjacent corner fittings, lying along the hinged panel edge which is opposite said edge thereof adjacent to the hinging axis, and in that in the hinged panel closed position, both said corner fittings connected to the hinged panels lie in said standard positions thereof and form together with the frame remaining portion, an integral structural element which meets the standard sizes for conveyable containers.

The invention further pertains to a structure obtained by assembling container-shaped elements.

Structures of this kind are known, as described for example in said Belgian Pat. Nos. BE-838053 and BE-883303, as well as in said French Pat. No. FR-2476716. In said French Patent, there is no actual assembly, but only joining of hinged panels from two containers in opened position, said panels being retained in such a position by specific supporting means and the gaps remaining therebetween being possibly covered with a shaped section. In Belgian Pat. Nos. BE-838053 and BE-883303, there is described the arranging side-by-side of a plurality of containers some walls of which have been unfolded, but nothing is stated regarding the possible provision of means for assembling or securing said unfolded walls together.

The present invention has for an object to provide by assembling together a plurality of structural elements according to the invention as defined hereinabove, or at least one such structural element with one or a plurality of known containers, a stable and strong structure which advantageously provides for a gangway between two containers, or a gangway cover between two containers, preferably level with one side from each said containers, said gangway or cover allowing when possible to bear a load or circulating between the containers. Moreover, said assembly should require a minimum number of parts and practical fasteners which are inexpensive and easy to handle.

BRIEF DESCRIPTION OF THE DRAWING

Other details and features of the invention will stand out from the following description, given by way of non limitative example and with reference to the accompanying drawings, in which:

FIG. 6 shows a partial view, with local breaking-away, of a structure according to the invention where two containers are joined by a gangway formed by two mutually-assembled movable panels.

FIG. 7 is a view on a larger scale, of that embodiment of the assembly of hinged panels from two containers as shown in FIG. 6.

FIG. 8 shows another embodiment of the assembly.

DESCRIPTION OF THE PREFERRED EMBODIMENTS

Figure 1:
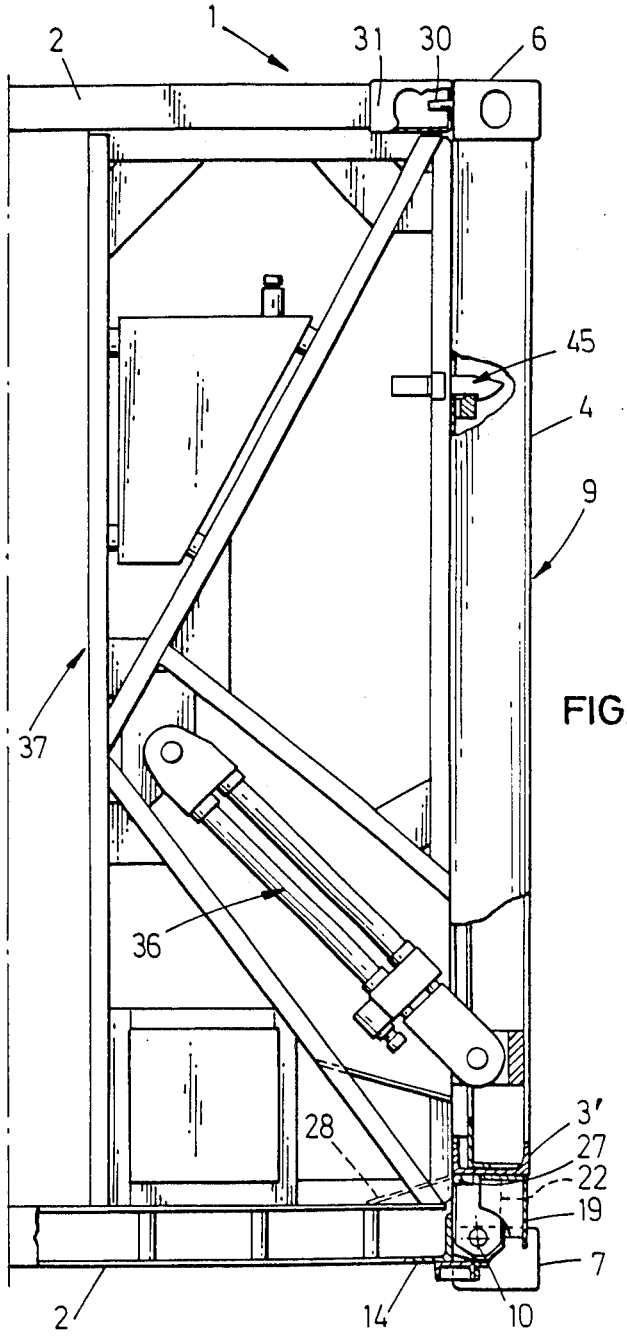
FIG. 1 is a partial side view, with local breaking-away, of a container according to the invention, wherein the back end wall is hinged.

In the drawings, identical or similar elements are shown with the same reference numerals.

The container 1 according to the invention as shown in FIGS. 1 to 4, comprises a frame formed by stringers 2, cross-beams 3 and uprights 4. Said conveyable container is of standard size and thus has standard corner fittings, four only of which are shown in the drawings. They are shown with reference numerals 5 to 8. Said fittings are the four corner fittings lying at the angles of the back end panel 9 of the container.

The standard corner fittings are components known per se and meet the size requirements of the International standards for conveying and handling ISO, and they will consequently not be described in detail here (see for instance on this subject L. A. HARLANDER, "Container System Design Developments over two decades", Marine Technology, Vol. 19, No. 4, October 1982, pp. 364–376, or also for example U.S. Pat. Nos. 3,691,595; 4,049,149, and 4,212,251).

Figure 5:
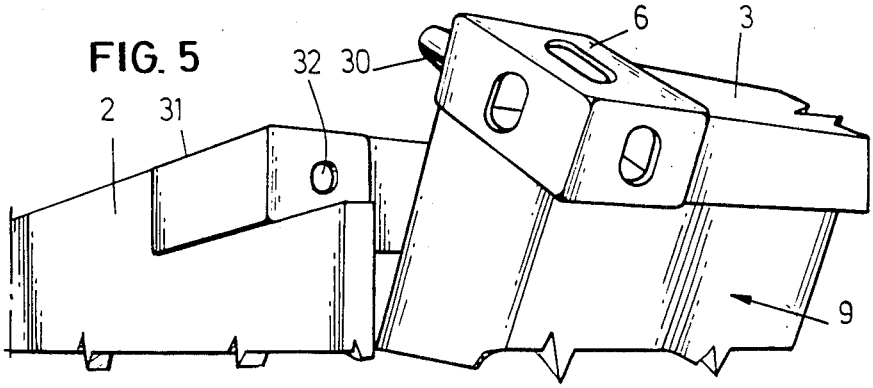
FIG. 5 is a diagrammatic perspective view of a container hinged panel according to the invention, while being opened.

It is however to be noted that the top corner fittings 5 and 6 are each secured rigidly in a known way to an upright 4 and to the top cross-beam 3, but said fittings are removably fastened to the back ends of the top stringers 2. In the example as shown in the figures, and particularly in FIGS. 1, 5 and 6, the corner fittings 5 and 6 are provided with a tube-like projection 30 of cone shape, on the side thereof facing the end of stringer 2. Said stringer is provided at the end thereof with a hollow prism-like fitting 31 having a circle-like opening 32 on that side thereof facing the corner fitting 5 or 6. The back end panel 9 which bears the corner fittings 5 and 6, is hinged to the container back. During the closing of panel 9, the cone-like projection 30 enters opening 32 which is slightly larger than the free end of projection 30. Said cone-like projection acts as an alignment cone for panel 9 relative to the frame remaining portion and allows securing by friction the corner fittings 5 and 6 on the prism-like fittings 31. One or a plurality of conventional locking elements 45 may moreover be provided between panel 9 and the frame.

On the other hand, it is also to be noted that the bottom corner fittings 7 and 8 remain integral with the container frame and thus do not swing together with panel 9, which notably allows to secure the container on a standard fastening or conveying support, with standard means.

In the case as shown, the movable panel 9 is supported on the frame through hinges which allow the panel 9 to swing about an axis 10. Said hinges are comprised in a known way of straps 11, pivot-pins 12 and hinge-pins 13. Said hinges have to be enclosed within the standard container volume. Therefor in the case as shown, provision is made to raise the bottom cross-beam 3' and to secure the straps 11 from the hinged panel 9 to the lower side 15 of cross-beam 3'. There is further provided an additional cross-beam 14, for example of angle-shape, between the back ends of the bottom stringers 2. The hinge-pins 13 are secured to the vertical side 16 of angle-iron 14. The axis 10 is so arranged as to have after swinging panel 9 over 90° outwards, the inner side 17 thereof level with the inner side 18 of the container floor, as is shown clearly in FIG. 3. The lower side 15 of cross-beam 3' moreover bears a flange from a second angle-iron 19, the second free flange 20 of which faces vertically downwards in the closed position of panel 9. Said angle-iron extends but between the hinges and is thus formed in the case shown, by two lengths. The flange 20 of angle-iron 19 thus extends along a plane identical or substantially identical with the plane of the outer side of panel 9. The angle-iron 19 further bears between both flanges thereof, a series of small reinforcement ribs 21, which lie vertically in the closed position of panel 9. Level with each hinge, stop elements 22 having a bearing surface which lies horizontally in the panel closed position, and vertically in the panel opened position, are fastened to cross-beam 3' between the angle-iron lengths 19.

The angle-iron 14 bears slightly projecting backwards, a reversed U-shaped section 23 which extends over the whole container width between both corner fittings 7 and 8. The back vertical flange of said shaped section 23 bears in turn a third angle-iron 24 the vertical flange of which is welded to the back vertical flange of shaped section 23. To the free horizontal flange of said angle-iron 24, a closing metal sheet 25 is bolted, which has a cross-section in the shape of an irregular polygon fragment. Actually said metal sheet is broken to allow the hinge-straps swinging, in the hinge location and is divided into two fragments. Said metal sheet 25 and the ribs 21 are so shaped as to let said ribs swing outwards of metal sheet 25 during the hinged panel opening. The angle-iron 24 is also divided into two lengths and in the hinge locations, the shaped section 23 bears on the back flange thereof, stop elements 26 having a vertical back side. Said latter side is used as support for the stop elements 22 from the hinged panel when said panel lies in its opened position. On the other hand, the size of the downward-facing back flange of shaped section 23 is so designed as to contact flange 20 of angle-iron 19 in the opened position of hinged panel 9, as it appears from FIG. 3.

Finally, the cross-beam 3' possibly further bears one or a plurality of small co-axial shafts 27 in parallel relationship with axis 10, and bearing one or a plurality of flaps 28 in such a way as to let said flaps swing freely relative to the hinged panel. The free end 29 of flap 28 bears on the container floor and in the closed position of the hinged panel, said flap thus lies in slanting position between shaft 27 and the container floor. At the end of the outward swinging motion of hinged panel 9, the flap or flaps 28 bear in horizontal position with the end 29 thereof on the top back corner of the floor which is chamfered in this location, in such a way that the upper surface 18 of the floor, the flap 28 and the inner surface 17 of hinged panel 9 lie in the same plane (see FIG. 3).

As may be seen from FIG. 6, the conveyable containers according to the invention may in a known way, be supported on a platform, for example a trailer frame 33, through the bottom corner fittings 7, 8 thereof, and standard fasteners 34 which may cooperate therewith and are provided on frame 33 (see for instance Great-Britain Pat. No. GB-1603613). Said platforms or trailer frames are quite often provided in turn with suspension systems. The invention provides for using said known suspension systems to align in an accurately horizontal plane at a given height, the container bottom wall. However, external means may be provided therefor, such as the means shown diagrammatically in FIG. 6, for example independent hydraulic or pneumatic jacks 35, which are arranged underneath frame 33.

Figure 2:
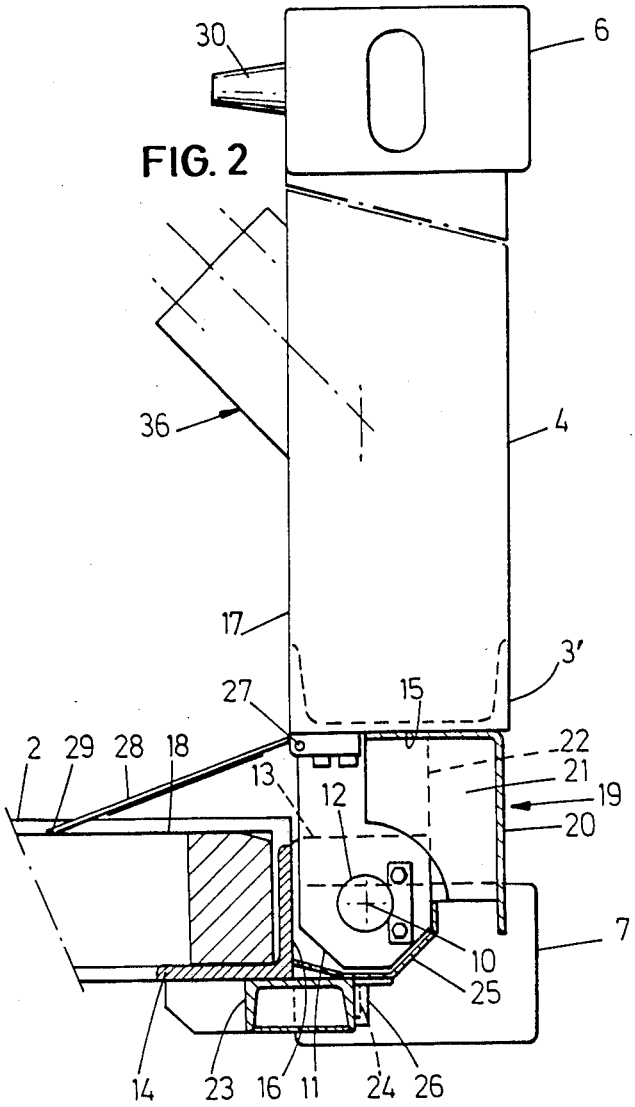
FIG. 2 shows on a larger scale, in closed position, the back end wall as shown in FIG. 1.
Figure 3:
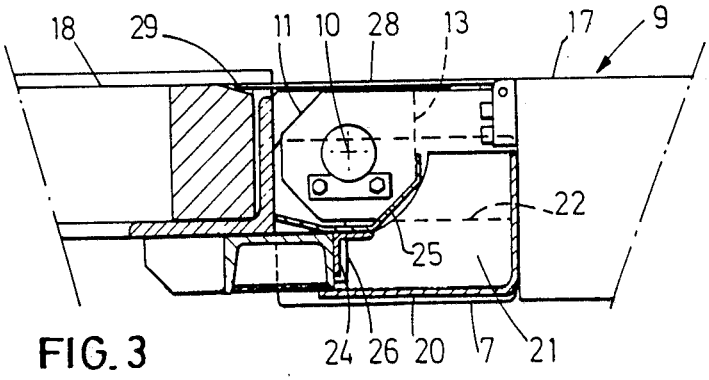
FIG. 3 shows said wall in opened position.
Figure 4:
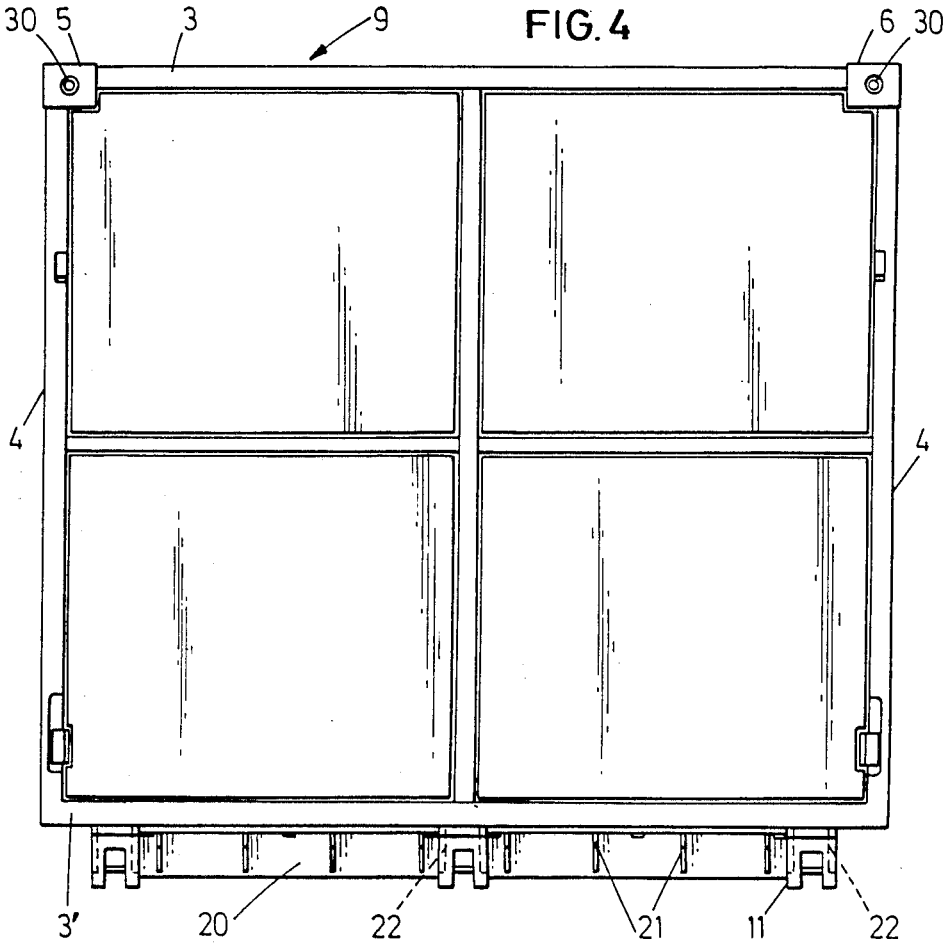
FIG. 4 shows from inside the container, the hinged wall by itself, as shown in FIGS. 1 to 3.

Finally as it appears from FIGS. 1 and 2, it is possible to obtain an opening which is controlled through one or a plurality of hydraulic, pneumatic, electric or other means. In the example as shown, a jack 36 is hingedly supported at one end, on a side framing 37 secured between the top and bottom stringers 2 from the one container side, and at the other end thereof, to hinged panel 9. Said jack may be used as additional locking means for the hinged panel 9 in the closed position thereof as well as in the opened position thereof, if the jack is retained operative between both said positions.

The structure shown in FIG. 6 is formed by two containers according to the invention, each supported on a trailer frame 33. The back walls thereof have been arranged facing one another, and the frames 33 have been brought in co-planar position in the above-described way. After opening and extending the respective panels 9 in horizontal position, the corner fittings 5, 6 which face one another are mutually connected by removable connecting fittings. Said fittings may be varied and it is possible to use as shown in FIG. 8, connecting fittings which have been known for a long time in the container art for other purposes, for example inserted stacking fittings 38, as described in U.S. Pat. Nos. 2,963,310; 3,691,595, 4,212,251, or Great-Britain Pat. No. 1,545,902. Said fittings 38 may be locked inside the openings in the facing corner fittings, by rotating the projections 39 thereof provided on either side of the small inserted plate 40, by means of a lever 44, and this when said projections have previously been fitted into said openings. It is also possible to provide as shown in FIGS. 6 and 7, the use of small fastening plates 41, similar to the plates described in Belgian Pat. No. 882,791. Said small plates can cover two sides on the same level of the standard corner fittings facing one another, and said plates are provided with fastening projections 42 which are swingable relative to the small plate under the action of a lever 43. When said projections are fitted into the openings provided therefor on the level sides of the corner fittings, they may be locked by swinging inside the cover fittings, which fixedly connects both panels 9 in opening position.

Both said assembly methods are particularly advantageous as they make use of simple connecting means and allow a rigid joining between panels 9, in such a way that the upper surface thereof be absolutely level. This is very important when such a structure is intended to form a passage gangway between two containers. Such an assembly method has the additional advantage of being very easy and fast to perform, simply by means of two very strong connecting parts, and of not requiring absolutely additional supports for the platform, even if said platform lies overhanging and is intended to bear loads.

Figure 9:
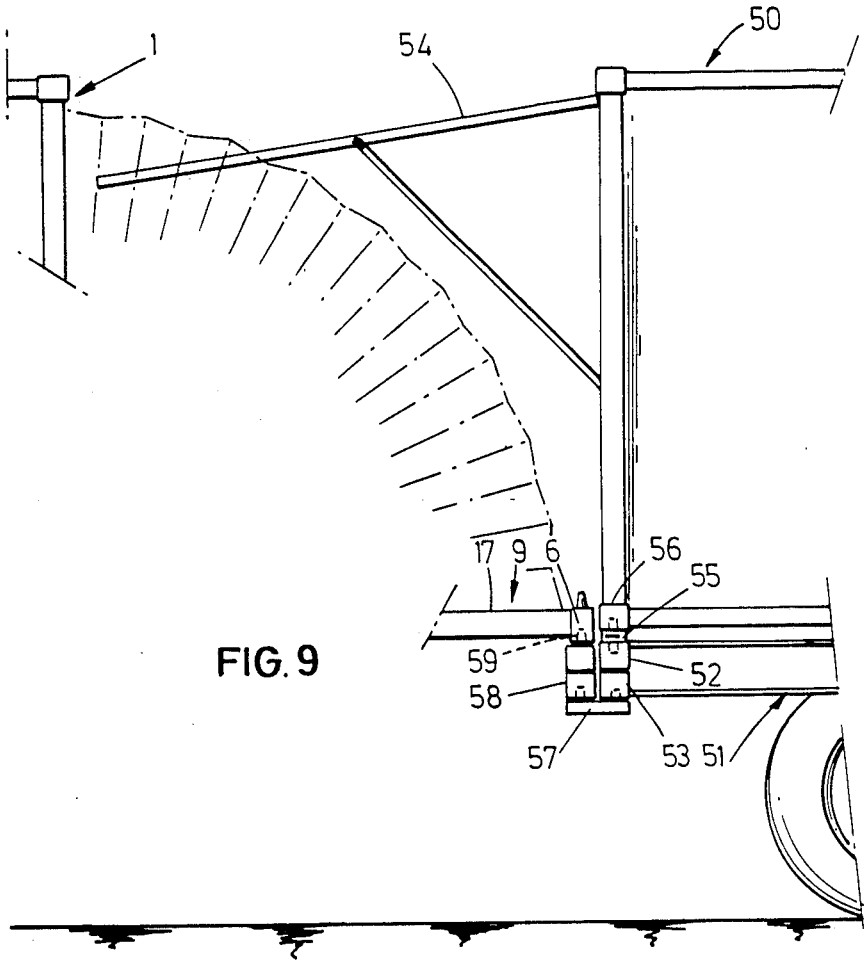
FIG. 9 is a partial view of another embodiment of a structure according to the invention.

In FIG. 9 there is shown a variation of a structure according to the invention obtained by assembling one container 1 according to the invention (only the end of panel 9 and the top part thereof are shown), with some known container 50, but supported by a trailer platform 51, such as described in Belgian Pat. No. BE-882,791, that is which has the feature of being provided on the corners thereof with a standard-size corner fitting 52 the standard-size fastening opening of which is directed upwards, for securing the container 50 on platform 51, as well as a connecting fitting 53 provided with a fastening opening facing downwards and possibly identical with corner fitting 52, but with a reversed position.

The container 50 as already stated, is of some known type; said container may allow opening the wall facing which lies panel 9 in opened position of container 1, whether by simply removing said wall, or by the swinging thereof about an axis. This is not however imperative. In the example shown, a container 50 has been selected only by way of example, as described in the above-mentioned Great-Britain Pat. No. GB-1603613, in which a panel 54 is swingable upwards to form a porch roof.

Said container 50 is supported on platform 51 by means of inserted stacking fittings 55. The top swinging projection thereof is engaged into the bottom corner fittings 56 of container 50, and the bottom swinging projection thereof into the corner fittings 52 of platform 51.

A fastening plate 57 similar to the plates described in Belgian Pat. No. BE-882,791 may be secured with the one swinging projection thereof into the connecting fitting 53 of platform 51 and may support with another swinging projection thereof, an adapter 58 whereon bears the corner fitting 6 from the panel 9 of container 1. Said adapter is provided on the lower surface thereof with a suitable opening for engaging a swinging projection from fastening plate 57, and on the upper surface thereof with a fixed lug 59 the shape of which is adapted to the shape of the front opening in corner fitting 6. Said lug is not only used to retain corner fitting 6, but also for lining-up panel 9 relative to container 50. The adapter 58 has a height which is so selected as to have surface 17 of panel 9 lying horizontally. It is naturally possible to consider fastening plate 57 and adapter 58 forming but one integral part.

It must be understood that the invention is in no way limited to the above embodiments and that many changes may be brought therein without departing from the scope of the invention as defined by the appended claims.

It is for instance possible that the mutual fastening means between the hinged panel and frame are not provided on the corner fittings proper, but on another frame location, by means for example of a conventional bolt which is however retractable inside the container walls.

It is also possible to provide other means for controlling the opening, or even hand-operated means.

It is further possible to consider providing instead of a horizontal surface level with the container floors, a horizontal surface level with the ceilings, in the shape of an intermediate roof between two containers. It would even be possible to consider a hinging about vertical axes and assembling by connecting vertical panels.

It must be understood that other panels than the back wall may be hinged, that a plurality of panels from one and the same container may swing, and that the wording "hinged panel" does comprise not only a complete wall as in the examples shown, but also simply part of a wall.

It is also possible to consider in the embodiment as shown in FIG. 9, the panel 54 from container 50 remaining closed. In this case, the structure according to the invention rather lies in providing for a side or front extension of the container according to the invention, without providing a passage from container 1 to container 50 through panel 9.

It is further possible to consider that with the opening of the movable panel according to the invention, said panel would take along a cover sheet arranged concertina-like or in some other way, to insure a weather protection for the gangway or the container extension which is thus formed. Such a cover sheet has been shown diagrammatically in FIG. 9, with dot-and-dash lines. Such a structure with cover sheet forming a side extension of the container according to the invention, is particularly suitable for designing a hospital unit, whether movable or not.

I claim:

1. A container-shaped conveyable structural element in the form of a parallelepiped and having a size corresponding to that of a standard container conforming with the ISO International Standard, comprising:

a frame bearing walls and corner fittings, said corner fittings being located in corner positions of said frame which corresponds to the standard corner positions of said standard container and having sizes corresponding to those of standard corner fittings defined by said International Standard, at least one hinged panel supported by said frame for rotation about an axis parallel to one edge of said frame, said hinged panel being rotatable, from a closed position in which it forms a wall of said structural element, in a direction outward from the remainder of said frame to an open position, said hinged panel having first and second corners located on an edge of said hinged panel which is opposite to said rotation axis, first and second corner fittings being affixed to the first and second corners of said hinged panel and being removably attachable to associated members of said frame when said hinged panel is in said closed position, said associated members aligning said first and second corner fittings in positions corresponding to said standard corner positions when said panel is in its closed position and fastening said corner fittings to the remainder of said frame thereby allowing handling of said structural element as a container, said first and second corner fittings being, in the open position of said hinged panel, attachable to corresponding corner fittings of an adjacent container; and stops means secured to said frame and to said hinged panel, said stop means being positioned so that the inner surface of said panel when in its open position is substantially coplanar with and adjacent to the inner surface of another wall of said structural element.

2. A structural element as defined in claim 1 which further comprises means attached at one end to said frame and the other end to said hinged panel for driving said panel between its closed and open positions.

3. A structural element as defined in claim 1 which further comprises a joint covering means attached to said hinged panel, said joint covering means covering a space between the inner surface of said panel and the inner side of the floor of said structural element when said panel is in its open position so as to form a continuous plane therebetween.

4. A structural element as defined in claim 1 which further comprises means for accurately positioning the bottom of said structural element in a horizontal plane at a predetermined height.

5. A structural element as defined in claim 1 which further comprises fastening means for removably connecting said first and second corner fittings to corner members of an adjacent container when a hinged panel member of said structural element is in its horizontal open position.

6. A structure comprising a plurality of container-shaped conveyable structural elements as defined by claim 1, and removable connecting means coupling the first and second corner fittings of the hinged panels of at least two adjacent structural elements when said hinged panels are in their open position.

7. A structure as defined in claim 6 wherein the hinged panels of adjacent structural elements are in a horizontal plane.

8. A structure comprising a plurality of container-shaped conveyable structural elements as defined in claim 1, which include two of said structural elements arranged with their hinged panels in their open position with the corner fittings therein fixedly supported thereby facing one another, and removable mutual connecting means coupling said facing first and second corner fittings of the hinged panels of said adjacent structural elements.

9. A structure as defined in claim 8 wherein said removable mutual connecting means includes locking means for locking the coupled panels in the open position.

10. A structure as defined in claim 9 wherein said locking means comprises an inserted stacking fitting interposed between each of said facing first and second corner fittings.

11. A structure as defined in claim 9 wherein said locking means comprises fastening plates affixed to horizontal surfaces of each pair of said first and second corner fittings.

12. A structure as defined in claim 8 wherein the inner surfaces of the connected hinged panels and the inner surfaces of a wall of each of said structural elements are coplanar thereby forming a large surface lying in a single plane.

13. A structure comprising a container-shaped conveyable structural element as defined by claim 1 and an adjacent container supported by a platform, which further comprises removable connecting means including first and second adapters for connecting said first and second corner fittings to corner fittings on said container when said hinged panel is in its open position.

* * * * *